US009728901B2

(12) United States Patent
Mukuno et al.

(10) Patent No.: US 9,728,901 B2
(45) Date of Patent: Aug. 8, 2017

(54) CONNECTOR STRUCTURE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Junichi Mukuno, Mie (JP); Kensaku Takata, Mie (JP)

(73) Assignees: AUTONETWORKS TECHNOLOGIES, Yokkaichi, Mie (JP); SUMITOMO WIRING SYSTEMS, LTD., Yokkaichi, Mie (JP); SUMITOMO ELCTRIC INDUISTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/310,803

(22) PCT Filed: May 18, 2015

(86) PCT No.: PCT/JP2015/064137
§ 371 (c)(1),
(2) Date: Nov. 14, 2016

(87) PCT Pub. No.: WO2015/186496
PCT Pub. Date: Dec. 10, 2015

(65) Prior Publication Data

US 2017/0093094 A1 Mar. 30, 2017

(30) Foreign Application Priority Data

Jun. 2, 2014 (JP) ..... 2014-113954

(51) Int. Cl.
*H01R 13/64* (2006.01)
*H01R 13/6584* (2011.01)
*H01R 13/52* (2006.01)

(52) U.S. Cl.
CPC ..... *H01R 13/6584* (2013.01); *H01R 13/5219* (2013.01)

(58) Field of Classification Search
CPC ..... H01R 13/28; H01R 12/91; H01R 33/7664
(Continued)

(56) References Cited

U.S. PATENT DOCUMENTS 7,588,449 B2 * 9/2009 Takehara ..... H01R 13/5219 439/247
7,749,010 B2 * 7/2010 Takehara ..... H01R 13/5219 439/247
(Continued)

FOREIGN PATENT DOCUMENTS

JP 6-140097 5/1994
JP 2011-9092 1/2001
(Continued)

OTHER PUBLICATIONS

International Search Report of Jun. 30, 2015.

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A connector structure (C) for connecting a plurality of electric devices accommodated in metal casings (10, 50) and arranged proximate to each other includes a first connector (30) provided in one (10) of the metal casings, a second connector (70) provided in the other (50) of the metal casings and configured to electrically connect the electric devices by being connected to the first connector (30), and
(Continued)

a conductive resilient member (90) arranged to be sandwiched between the both metal casings while being electrically conductive to the metal casings (10, 50) and surround connected parts of the first and second connectors (30, 70).

5 Claims, 5 Drawing Sheets

(58) Field of Classification Search
USPC ..... 439/247, 248, 384, 382
See application file for complete search history.

(56) References Cited

U.S. PATENT DOCUMENTS

| | | | | |
|---|---|---|---|---|
| 2002/0031931 | A1* | 3/2002 | Yokoyama | H01R 13/6315 439/247 |
| 2007/0218736 | A1* | 9/2007 | Takizawa | H01R 11/01 439/247 |
| 2007/0218747 | A1* | 9/2007 | Takehara | H01R 13/5219 439/382 |
| 2009/0258531 | A1* | 10/2009 | Oka | H01R 13/533 439/382 |
| 2012/0015546 | A1* | 1/2012 | Yamaguchi | H01R 13/05 439/370 |
| 2014/0148045 | A1* | 5/2014 | Kashiwada | H01R 23/7073 439/485 |

FOREIGN PATENT DOCUMENTS

| | | |
|---|---|---|
| JP | 2007-280913 | 10/2007 |
| JP | 2011-65748 | 3/2011 |

* cited by examiner

CONNECTOR STRUCTURE

BACKGROUND

1. Field of the Invention

The present invention relates to a connector structure.

2. Description of the Related Art

In electric vehicles and hybrid vehicles, a travel motor and an inverter device for driving this travel motor often are connected by a wiring harness having an electromagnetic wave shielding function. However, in recent years, it has been considered to connect an inverter device and a motor by direct-connection type connectors without using a wiring harness, for example, as described in Japanese Unexamined Patent Publication No. 2007-280913) for the miniaturization and weight reduction of a device configuration.

A configuration in which the inverter device (power converter) and the motor (electric motor) are accommodated respectively in individual metal casings and a male connector and a female connector to be connected to each other are fixed to the respective metal casings is disclosed in the above publication. The two connectors can be fitted and connected by arranging the inverter device near the motor so that both devices can be connected electrically without using a wiring harness.

Particularly in devices subject to a lot of vibration such as those mounted in a vehicle, both devices cannot be arranged at a very short distance from each other if the collision of the devices caused by vibration is considered. Further, since terminal fittings and, eventually, the connector housings are enlarged as ampacities of the connectors increase. Thus, a gap between the both devices has to be widened.

Thus, noise may leak out from the above gap between the devices and a reduction of the electromagnetic wave shielding property has become problematic in connectors of a type directly connected to devices.

SUMMARY

A connector structure in accordance with this specification is configured for connecting a plurality of electric devices accommodated in metal casings and arranged proximate to each other. The connector structure includes a first connector in one of the metal casings and a second connector provided in the other of the metal casings. The second connector is configured to connect the electric devices electrically by being connected to the first connector. A conductive resilient member is arranged to be sandwiched between the metal casings while being electrically conductive to the metal casings and surrounding connected parts of the first and second connectors.

According to this configuration, the metal casings and the conductive resilient member are connected electrically by sandwiching the conductive resilient member between the metal casings. Additionally, the conductive resilient member surrounds the connected parts of the first and second connectors so that shielding can be provided between the metal casings. Further, by sandwiching the conductive resilient member between the metal casings, an error at the time of connector connection caused by a displacement between the metal casings can be absorbed by a resilient force.

The connected parts of the first and second connectors may be sealed from the surroundings in a watertight manner by compressing the conductive resilient member between the metal casings. In this configuration, the conductive resilient member can also have a waterproof property without using a separate waterproof member.

One of the electric devices may be a motor for vehicle and the other electric device may be an inverter device for driving the motor. This configuration is preferable since a large current flows between the motor and the inverter device and electromagnetic radiation is likely to occur.

The second connector may include a terminal fitting and a connector housing for accommodating the terminal fitting. A reinforcing flange made of metal may be arranged on an outer periphery of the connector housing, and the reinforcing flange may include a fixing portion for fixing the second connector to the metal casing in an electrically connected state. An annular contact portion may be contacted by the conductive resilient member. According to this configuration, a conductive circuit can be configured utilizing the reinforcing flange that also is used to fix the second connector.

The metal casing may include a backup ring to be held in contact with the second connector on a side of the second connector opposite to the contact portion. According to this configuration, the backup ring supports the contact portion of the reinforcing flange subjected to a reaction force from the conductive resilient member from a side opposite to the contact portion. By supporting the reinforcing flange, it is possible to suppress the bending of the reinforcing flange by the reaction force from the conductive resilient member and to maintain a contact pressure with the conductive resilient member.

According to the connector structure disclosed in this specification, it is possible to ensure an electromagnetic wave shielding property in a connector structure for directly connecting a plurality of electric devices arranged proximate to each other.

DETAILED DESCRIPTION

A first embodiment is described with reference to FIGS. 1 to 4. A connector structure C for electrically connecting an unillustrated motor and an unillustrated inverter device for driving this motor, for example, in a hybrid vehicle or an electric vehicle is illustrated in this embodiment.

Figure 3:
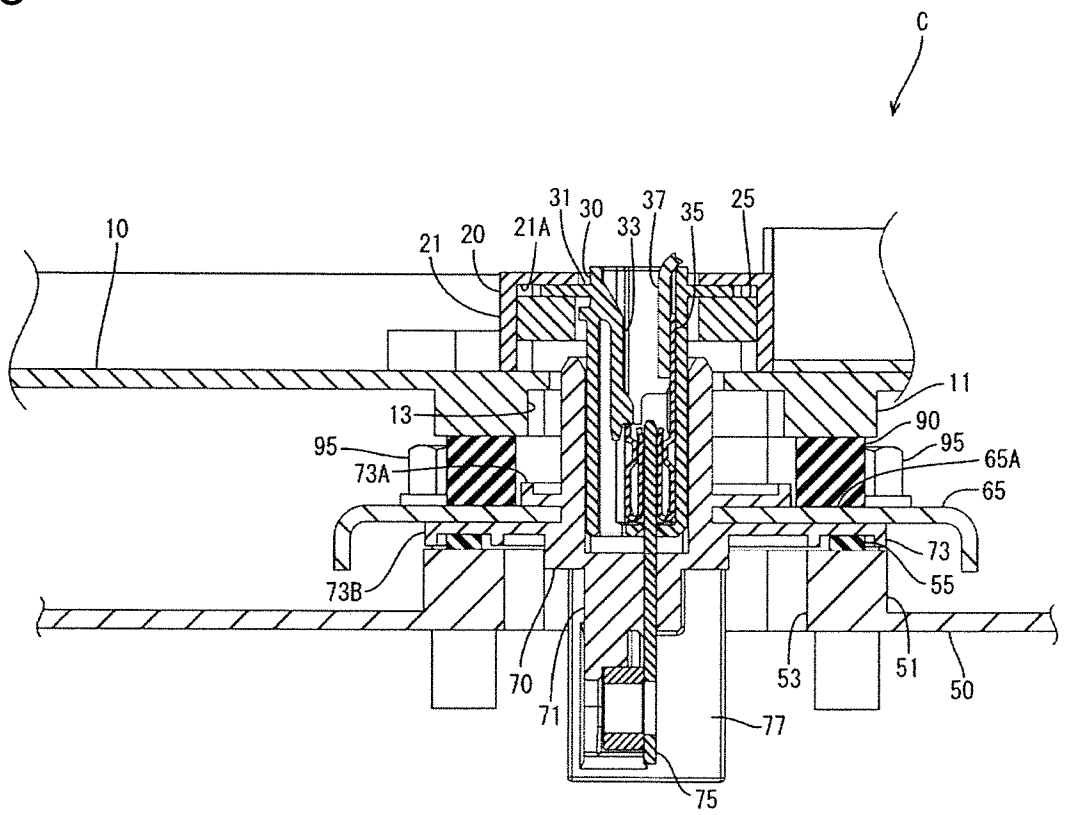
FIG. 3 is a section, corresponding to a cross-section along III-III of FIG. 1, showing the connected parts of an inverter-device-side terminal and a motor-side terminal.
Figure 4:
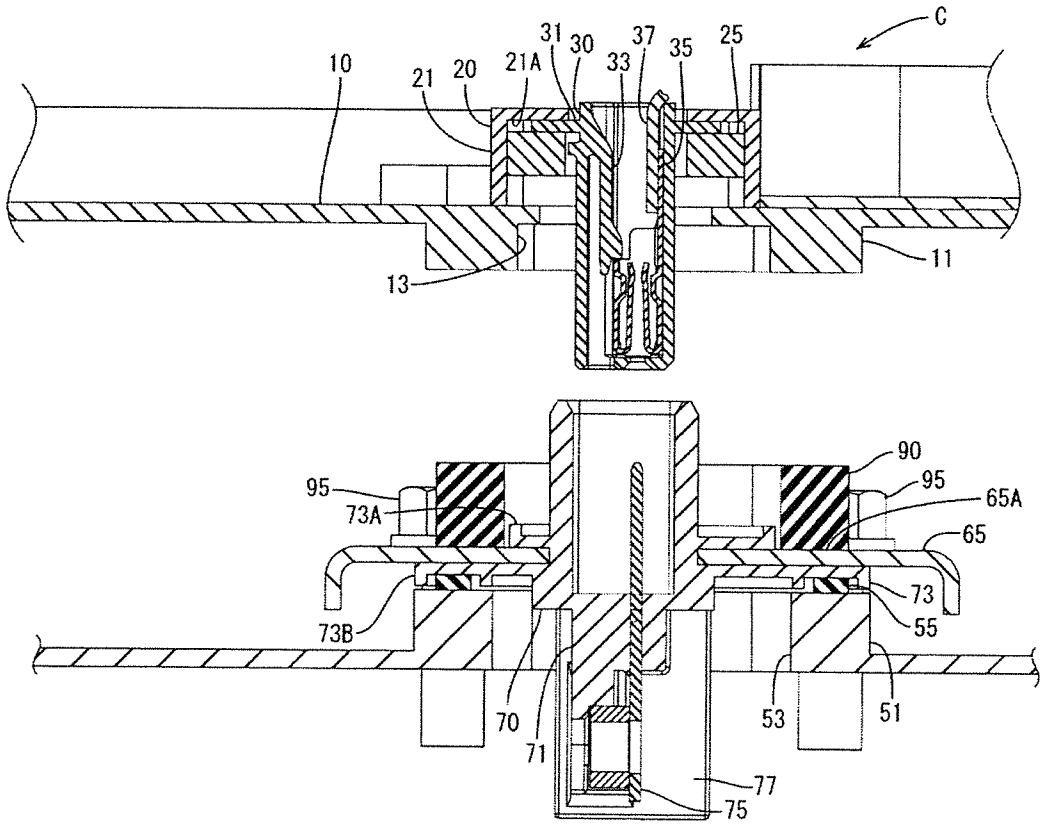
FIG. 4 is a section showing a state before the inverter-device-side terminal and the motor-side terminal are connected.

The connector structure C of this embodiment includes inverter-device-side connectors 30 provided in an inverter case 10, motor-side connectors 70 provided in a motor case 50 and a conductive rubber 90 sandwiched between the inverter case 10 and the motor case 50 as shown in FIGS. 3 and 4.

Figure 1:
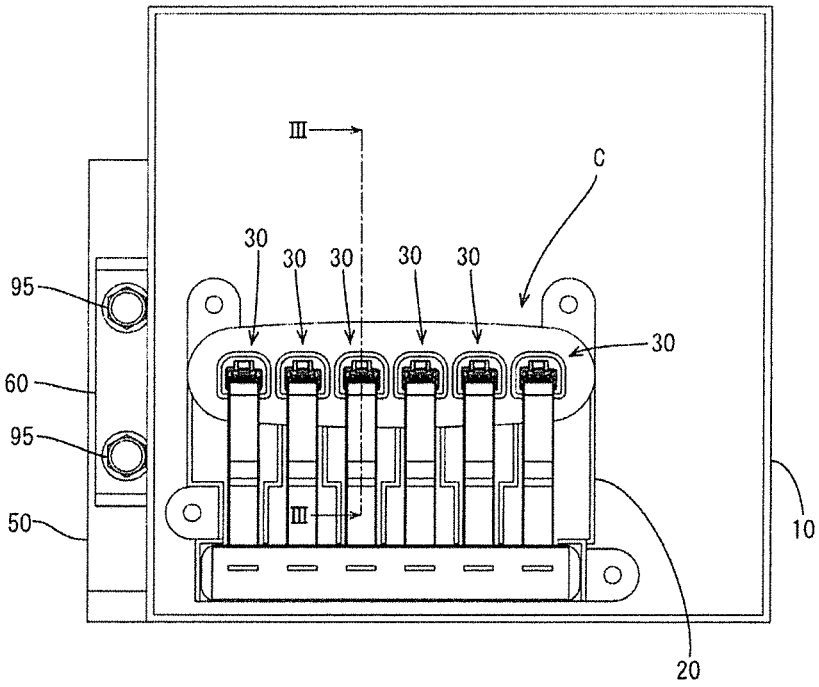
FIG. 1 is a plan view of connected parts of an inverter-device-side terminal block and a motor-side terminal block in a first embodiment.
Figure 2:
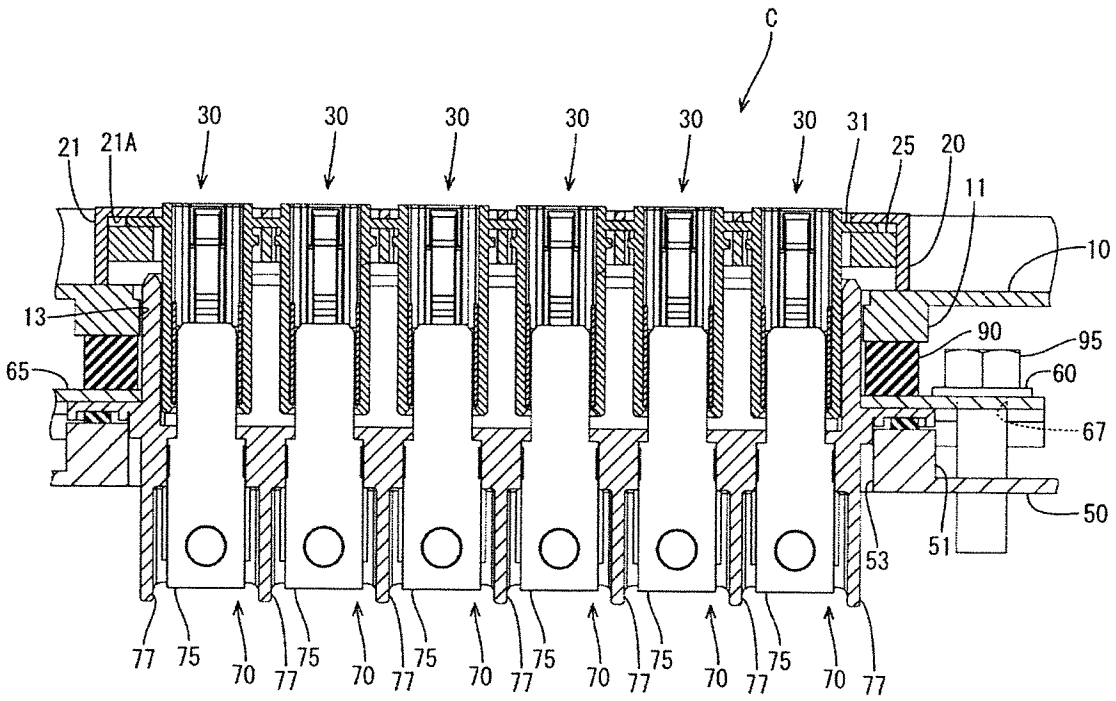
FIG. 2 is a front view of the connected parts of the inverter-device-side terminal block and the motor-side terminal block.

As shown in FIGS. 1 and 2, six inverter-device-side connectors 30 and six motor-side connectors 70 are arranged in parallel along a direction perpendicular to a connecting direction of the inverter-device-side connectors 30 and the motor-side connectors 70 between the inverter device and the motor to electrically connect the inverter device and the motor. The six inverter-device-side connectors 30 are collectively supported in an inverter-device-side terminal block 20. Similarly, the six motor-side connectors 70 also are supported collectively in a motor-side terminal block 60. In FIGS. 1 and 2, only a lower part of the inverter case 10 covering lower sides of the inverter device and only an upper part of the motor case 50 covering an upper side of the motor are shown when an upper side is an inverter device side and a lower side is a motor side in a connecting direction of the inverter-device-side connectors 30 and the motor-side connectors 70.

The inverter case 10 is formed of conductive metal and accommodates the unillustrated inverter device in a watertight manner inside. As shown in FIGS. 2 to 4, an opening 13 is provided on a lower surface part of the inverter case 10 and an annular inverter-device-side rib 11 projecting downward is provided on a peripheral edge part of the opening 13.

As shown in FIGS. 3 and 4, the inverter-device-side terminal block 20 is mounted in the inverter case 10 with the lower surface thereof placed in contact with the lower inner wall of the inverter case 10 and a lower part of the inverter-device-side connector 30 inserted through the inverter-device-side opening 13 of the inverter case 10. A connector mounting portion 21 on which the inverter-device-side connectors 30 are to be mounted is provided on a part of the inverter-device-side terminal block 20. The connector mounting portion 21 is in the form of a short tube opening downward.

The inverter-device-side connector 30 is in the form of a tube open in a vertical direction and has a tube axis direction extending in the vertical direction. A bulging portion 31 is provided on the outer surface of the inverter-device-side connector 30 near an upper opening and bulges out in parallel to the lower surface of the inverter case 10. The inverter-device-side terminal 35 is accommodated on a lower opening side in the inverter-device-side connector 30. The inverter-device-side terminal 35 is a female terminal and is held by a locking lance 33 extending from an inner wall of the inverter-device-side connector 30 near the upper opening with a connection port thereof faced down.

The bulging portion 31 of the inverter-device-side connector 30 is placed in contact with an upper surface 21A of the connector mounting portion 21 and, further, an annular retainer 25 is mounted from a lower opening side of the connector mounting portion 21 with the inverter-device-side connector 30 inserted inside. In this way, the inverter-device-side connector 30 is mounted with the bulging portion 31 thereof sandwiched between the connector mounting portion 21 and the retainer 25.

A part of the inverter-device-side terminal 35 opposite to the connection port extends up to the vicinity of the upper opening of the inverter-device-side connector 30 along an inner wall of the inverter-device-side connector 30 and is connected to one end part of a braided wire 37. The braided wire 37 is a flexible conductive member and routed as an internal wiring in the inverter-device-side terminal block 20. An end part of the braided wire 37 opposite to the end part connected to the inverter-device-side terminal 35 is connected electrically connected to the inverter device.

On the other hand, the motor case 50 is formed of conductive metal and accommodates the unillustrated motor in a watertight manner inside. As shown in FIGS. 2 to 4, a motor-side opening 53 is formed on the upper surface of the motor case 50 and an annular motor-side rib 51 projecting upward is provided on a peripheral edge part of the motor-side opening 53.

As shown in FIGS. 1 and 2, the motor-side terminal block 60 is mounted in the motor case 50 to be placed in an upper part of the motor case 50. As shown in FIGS. 2 to 4, the motor-side connectors 70 are fixed to the motor-side terminal block 60 and a reinforcing flange 65 made of metal and integrated, for example, by insert molding is provided around the motor-side connectors 70. The outer peripheral edge of the reinforcing flange 65 is bent down, and bolt holes 67 are provided on end parts of the reinforcing flange 65 for receiving bolts 95. The reinforcing flange 65 is fixed to the motor case 50 by the bolts 95 so that the plate surfaces of the reinforcing flange 65 are parallel to the upper surfaces of the motor-side connectors 70. Thus, the reinforcing flange 65 is electrically conductive to the motor case 50.

As shown in FIGS. 2 to 4, the motor-side connector 70 includes a connector housing 71 having a substantially tubular shape that opens up and has a vertical tube axis direction. A sandwiching portion 73 projects from the outer periphery of the connector housing 71 to sandwich the reinforcing flange 65. The sandwiching portion 73 is composed of annular upper and lower pieces 73A, 73B projecting out while being arranged side by side in the vertical direction, and the reinforcing flange 65 is sandwiched between the upper and lower pieces 73A, 73B. The lower piece 73B of the sandwiching portion 73 projects up to a position above the motor-side rib 51, whereas the upper piece 73A is shorter than the lower piece 73B. Thus, a placing surface 65A of the reinforcing flange 65 is exposed.

A motor-side terminal 75 is held in the connector housing 71. The motor-side terminal 75 is a male terminal and extends in the vertical direction in the connector housing 71 with an upper side as a connection side. A lower end part of the motor-side terminal 75 is connected to an unillustrated motor-side power line by bolting. Adjacent motor-side terminals 75 are partitioned by partition walls 77 integrally formed to the connector housings 71.

As shown in FIGS. 2 to 4, the motor-side terminal block 60 is mounted in and fixed to the motor case 50 with the reinforcing flange 65 and the sandwiching portion 73 of the motor-side terminal block 60 placed on the motor-side rib 51 of the motor case 50 via a seal 55 and lower parts of the connector housings 71 inserted through the motor-side opening 53 of the motor case 50.

The seal 55 placed on the motor-side rib 51 is resilient and is arranged between the lower piece 73B of the sandwiching portion 73 of the motor-side terminal block 60 and the motor-side rib 51 of the motor case 50 to provide surface sealing therebetween. In this way, the seal 55 prevents intrusion of water and the like into the motor case 50. Further, the seal 55 is formed of oil-resistant acrylic resin and prevents the leakage of oil and the like from the interior of the motor case 50 to outside by sealing between the lower piece 73B of the sandwiching portion 73 and the motor-side rib 51.

In the connector structure C configured as described above, the motor-side connector 70 is fit into the inverter-device-side connector 30 from below and the inverter-device-side terminal 35 and the motor-side terminal 75 are mated in the vertical direction, as shown in FIG. 3. Accordingly, the terminals 35, 75 are connected electrically with the inverter case 10 and the motor case 50 facing each other. As a result, the inverter device and the motor are connected directly and alternating-current power converted in the inverter device is supplied to the motor.

Further, as shown in FIG. 3, when the inverter-device-side connector 30 and the motor-side connector 70 are connected, the annular conducive rubber 90 is arranged to surround connected parts of the inverter-device-side connector 30 and the motor-side connector 70 between the inverter case 10 and the motor-side terminal block 60. The conductive rubber 90 is placed on the placing surface 65A of the motor-side terminal block 60 between the inverter case 10 and the motor-side terminal block 60 while facing the inverter-device-side rib 11 of the inverter case 10.

The conductive rubber 90 is formed of a conductive resilient material obtained by adding conductive filler such as silver or silver-plated glass fibers to a silicon rubber base material, resilient and arranged in a compressed state between the inverter-device-side rib 11 of the inverter case 10 and the placing surface 65A of the motor-side terminal block 60. Note that a downward load is applied to the reinforcing flange 65 from the compressed conductive rubber 90. However, deflection and deformation of the reinforcing flange 65 is prevented since the reinforcing flange 65 is supported by the motor-side rib 51 via the lower piece 73B of the sandwiching portion 75.

According to this configuration, the connected parts of the inverter-device-side connector 30 and the motor-side connector 70 are exposed to the outside in a gap between the inverter case 10 and the motor case 50. However, these connected parts are surrounded by the annular conductive rubber 90, the upper surface of the conductive rubber 90 is held in close contact with the inverter-device-side rib 11 of the inverter case 10 and the lower surface thereof is held in close contact with the reinforcing flange 65 so that electromagnetic radiation from the connected parts of the connectors 30, 70 is shielded. Of course, the conductive rubber 90 is not water-permeable so that watertight sealing is provided between the cases 10, 50.

Further, by sandwiching the conductive rubber 90 between the inverter case 10 and the motor case 50 (motor-side terminal block 60), an error at the time of connecting the both connectors 30, 70 caused by a displacement between the inverter case 10 and the motor case 50 (motor-side terminal block 60) can be absorbed by a resilient force of rubber.

A second embodiment is described with reference to FIG. 5. A connector structure C1 of this embodiment differs from the first embodiment in that the reinforcing flange 65 is not used. Note that members and parts having the same functions as in the first embodiment are denoted by the same reference signs and not described or briefly described.

Figure 5:
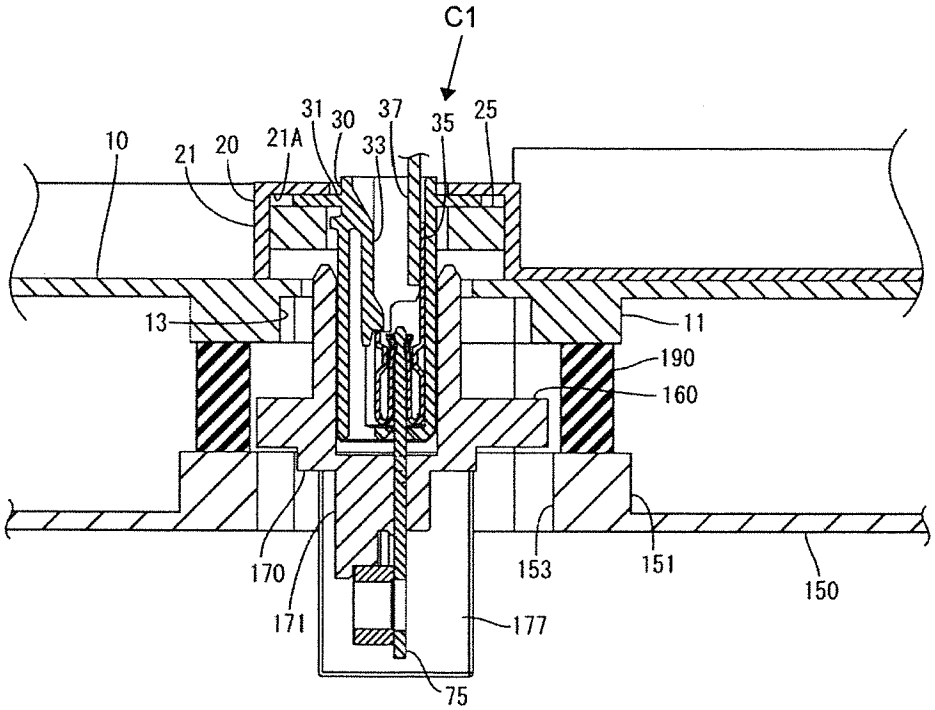
FIG. 5 is a section showing connected parts of an inverter-device-side terminal and a motor-side terminal in a second embodiment.

The connector structure C1 of this embodiment includes inverter-device-side connectors 30 provided in an inverter case 10, motor-side connectors 170 provided in a motor case 150 and a conductive rubber 190 sandwiched between the inverter case 10 and the motor case 150 as shown in FIG. 5. A motor-side opening 153 of the motor case 150 is sized so that a motor-side terminal block 160 can be accommodated therein, and an upwardly projecting annular motor-side rib 151 is provided on a peripheral edge part of this motor-side opening 153.

The motor-side terminal block 160 is mounted in the motor case 150 by an unillustrated method. Motor-side connectors 170 are formed integrally to form the motor-side terminal block 160. The motor-side connectors 170 hold motor-side terminals 75 and are configured similar to the first embodiment except a mounting method into the motor-side terminal block 160. Thus, the motor-side connectors 170 are not described When the inverter-device-side connector 30 and the motor-side connector 170 are connected, the annular conductive rubber 190 is arranged to surround connected parts of the inverter-device-side connector 30 and the motor-side connector 170 between the inverter case 10 and the motor case 150. This conductive rubber 190 is placed on the motor-side rib 151 to be sandwiched between the inverter-device-side rib 11 of the inverter case 10 and the motor-side rib 151 between the inverter case 10 and the motor case 150. The conductive rubber 190 is not described since it is configured similar to the first embodiment except in having such a thickness as to be compressed between the inverter-device-side rib 11 and the motor-side rib 151.

As described above, in this embodiment, the annular conductive rubber 190 is arranged to surround the connected parts of the inverter-device-side connector 30 and the motor-side connector 170 between the inverter case 10 and the motor case 150 when the inverter-device-side connector 30 and the motor-side connector 170 are connected. The conductive rubber 190 is compressed by the cases 10, 150, the upper surface thereof is held in close contact with the inverter-device-side rib 11 of the inverter case 10 and the lower surface thereof is held in close contact with the motor-side rib 151. Thus, electromagnetic radiation from the connected parts of the connectors 30, 170 is shielded. Of course, since the conductive rubber 190 is not water-permeable, watertight sealing can be provided between the both cases 10, 50.

The technique disclosed in this specification is not limited to the above described and illustrated embodiments. For example, the following various modes are also included.

In the above embodiments, the plurality of connectors 30, 70, 170 are collectively shielded by the conductive rubber 90, 190 after being fixed in the terminal blocks. However, shielding may be provided for each connected part of each connector 30, 70, 170.

Although six connectors 30 and six connectors 70, 170 are arranged and connected in the above embodiments, the number of connector connections may be 1 or another number equal to or greater than 2.

Although the conductive rubber 90, 190 is impervious to water in the above embodiments, it may not be impervious to water. In this case, gaps between the inverter case 10 and the motor-side connectors 70, 170 may be held watertight by an O-ring or the like.

Although the conductive rubber 90, 190 is silicon added with conductive filler or the like in the above embodiments, metallic wiring may be applied to the surface of rubber or another material may be used if a resilient member and a conductive member are formed to be integrally handled such as a material obtained by covering a braided wire from above with rubber.

Although the inverter-device-side connectors 30 are floating-supported in the above embodiments, they may be supported by another method.

Although the inverter device and the motor are connected in the above embodiments, other devices may be connected.

Although the seal member 55 is arranged between the motor-side terminal block 60 and the motor-side rib 51 in the above first embodiment, the arrangement position of the seal member 55 is not limited.

LIST OF REFERENCE SIGNS

10 . . . inverter case (one metal casing)
20 . . . inverter-device-side terminal block
30 . . . inverter-device-side connector (first connector)

35 . . . inverter-device-side terminal
50, 150 . . . motor case (other metal casing)
51, 151 . . . motor-side rib (backup ring)
55 . . . seal
60, 160 . . . motor-side terminal block
65 . . . reinforcing flange
65A . . . placing surface (contact portion)
67 . . . bolt hole (fixing portion)
70, 170 . . . motor-side connector (second connector)
71 . . . connector housing
75 . . . motor-side terminal (terminal fitting)
90, 190 . . . conductive rubber (conductive resilient member)
95 . . . bolt (fixing portion)
C, C1 . . . connector structure

The invention claimed is:

1. A connector structure for connecting a plurality of electric devices accommodated in metal casings and arranged proximate to each other, comprising:

a first connector provided in one of the metal casings;

a second connector provided in the other of the metal casings and configured to electrically connect the electric devices by being connected to the first connector; and a conductive resilient member arranged to be sandwiched between the both metal casings while being electrically conductive to the metal casings and surround connected parts of the first and second connectors wherein:

the one metal casing includes an annular first rib provided on a peripheral edge part of the first connector and projecting toward the other metal casing and the other metal casing includes an annular second rib provided on a peripheral edge part of the second connector and projecting toward the one metal casing; and the conductive resilient member is compressed between the first and second ribs.

2. The connector structure of claim 1, wherein the connected parts of the first and second connectors are sealed from surrounding in a watertight manner by the conductive resilient member being arranged to be compressed between the both metal casings.

3. The connector structure of claim 2, wherein one of the electric devices is a motor for vehicle and the other electric device is an inverter device for driving the motor.

4. The connector structure of claim 1, wherein the second connector includes a terminal fitting, a connector housing for accommodating the terminal fitting and a reinforcing flange made of metal and arranged on an outer periphery of the connector housing, and the reinforcing flange includes a fixing portion for fixing the second connector to the metal casing in an electrically connected state and an annular contact portion to be contacted by the conductive resilient member.

5. The connector structure of claim 4, wherein the metal casing includes a backup ring to be held in contact with the second connector on a side of the second connector opposite to the contact portion.

* * * * *